US006056500A

United States Patent [19]

Wicén

[11] Patent Number: 6,056,500

[45] **Date of Patent: *May 2, 2000**

[54] VACUUM HOISTING DEVICE HAVING A VERTICALLY SUSPENDED LIFTING TUBE

[75] Inventor: Jan Wicén, Arjeplog, Sweden

[73] Assignee: AB Initio Affärs- & Teknikutveckling, Arjeplog, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/155,533

[22] PCT Filed: Mar. 26, 1997

[86] PCT No.: PCT/SE97/00545

§ 371 Date: Nov. 9, 1998

§ 102(e) Date: Nov. 9, 1998

[87] PCT Pub. No.: WO97/36818

PCT Pub. Date: Oct. 9, 1997

[30] Foreign Application Priority Data

Mar. 29, 1996 [SE] Sweden ..... 9601232

[51] Int. Cl.[7] ..... B66C 1/02

[52] U.S. Cl. ..... 414/627; 414/752; 294/64.1; 212/284

[58] Field of Search ..... 414/627, 752, 414/591; 294/64.1; 212/285, 284

[56] References Cited

U.S. PATENT DOCUMENTS

| | | | |
|---|---|---|---|
| 3,033,381 | 5/1962 | Noble et al. | 414/627 |
| 3,219,380 | 11/1965 | Carliss | 414/627 |
| 3,743,340 | 7/1973 | Williamann | 414/627 |
| 3,933,388 | 1/1976 | Conboy | 414/627 |
| 4,412,775 | 11/1983 | Molitor et al. | 414/627 |
| 4,413,853 | 11/1983 | Andersson | 414/627 |
| 4,557,659 | 12/1985 | Scaglia | 294/64.1 |
| 4,917,568 | 4/1990 | Hawkswell | 294/64.1 |
| 5,044,868 | 9/1991 | Bennison | 294/64.1 |
| 5,330,314 | 7/1994 | Bennison | 294/64.1 |
| 5,431,469 | 7/1995 | Ohno et al. | 414/627 |
| 5,791,861 | 8/1998 | Seelig | 414/627 |
| 5,816,635 | 10/1998 | Jansson | 414/627 |

FOREIGN PATENT DOCUMENTS 2200615 of 0000 United Kingdom .

*Primary Examiner*—Gregory A. Morse
*Attorney, Agent, or Firm*—Ware, Fressola, Van der Sluys & Adolphson LLP

[57] ABSTRACT

The invention relates to a vacuum hoisting device of the kind having a vertically suspended lifting tube (4), which is extensible and contractible depending upon the air pressure in the lifting tube, and which at its lowest part is provided with a suction device (6) in the shape of one or more suction cups. Up to now, a valve at the suction device has been used for maneuvering the suction device, which valve when closed brings a vacuum source (7,20) to work with a constant suction capacity to decrease the pressure in the lifting tube such that an object (32) to be lifted is attached by the suction after which the lifting tube is contracted such that the object is lifted. To limit the lifting height and to lower and release the object, it has been necessary to partially open the valve and permit a restricted inlet of air and at last completely open the valve resulting in a large consumption of air. According to the invention, there is instead a valve (14,23) arranged to control the suction capacity of the vacuum source in direct dependence on the desired air pressure in the lifting tube (4).

7 Claims, 3 Drawing Sheets

VACUUM HOISTING DEVICE HAVING A VERTICALLY SUSPENDED LIFTING TUBE

BACKGROUND OF THE INVENTION

1. Technical Field

The present invention relates to a vertical lifting tube suspended at its upper part and provided at its lower part with one or more suction cups. The lifting tube is connected to a vacuum source and is axially extensible and contractible depending upon the magnitude of the current air pressure in the lifting tube. The pressure in the lifting tube is manually adjustable by means of valve operated by a regulating means.

2. Description of the Prior Art

Hoisting devices of this type are known for instance by SE 451 834, and are provided with a valve device at the lower part of the lifting tube by means of which surrounding air, when required, can be let into the interior of the lifting tube such that the air pressure in the lifting tube can be regulated to permit lifting and lowering of the lower part of the lifting tube in a desired manner. This results in an extremely simple mode of operating of the lifting device by holding an object by suction, lifting the suction device and the object, lowering same, and delivering of the object only by the aid of the valve device.

A drawback to this known type of hoisting device is that the vacuum device, a vacuum pump or an ejector device driven by compressed air, is operated all the time with maximum vacuum flow that is dimensioned for the heaviest expected load and for fast lifting operations. As soon as the lifting operation is finished after 1–2 seconds, the demand of vacuum flow is essentially reduced in dependence on how much leakage there is through the object that is lifted and around the edges of the suction device. This means that it is necessary to let in air into the lifting tube corresponding to the over-capacity of the vacuum source. If this is not done the vacuum level in the lifting tube will increase and the load will rise to maximum lifting height which is not desirable. All the air let in generates a completely unnecessary pumping work which calls for unnecessarily strong dimensioning of the pump and raises the manufacturing costs as well as the operating costs. Vacuum flows of this magnitude normally also make it necessary to use fans and make it impossible to use simple and easily applicable ejectors driven by compressed air.

SUMMARY OF THE INVENTION

The object of the invention is to achieve a single and economically working lifting device of the kind mentioned in the introduction where the above mentioned drawbacks are eliminated.

This is achieved according to the invention in that the vacuum lifting device has a valve arranged to control the suction capacity of the vacuum source. Instead of regulating the vacuum level in the lifting tube in the known way by letting in air through a valve, the invention prescribes a solution of the problem of controlling the lifting tube by using the valve for controlling the suction capacity of the suction source or in other words the vacuum flow. Hence, the vacuum flow is heavy during the very lifting operation but after that not heavier than the leakage into the lifting tube.

BRIEF DESCRIPTION OF THE DRAWINGS

The invention will now be disclosed more in detail with reference to the accompanying drawings showing by way of example various embodiments of devices according to the invention in which.

DETAILED DESCRIPTION OF THE INVENTION

Figure 1:
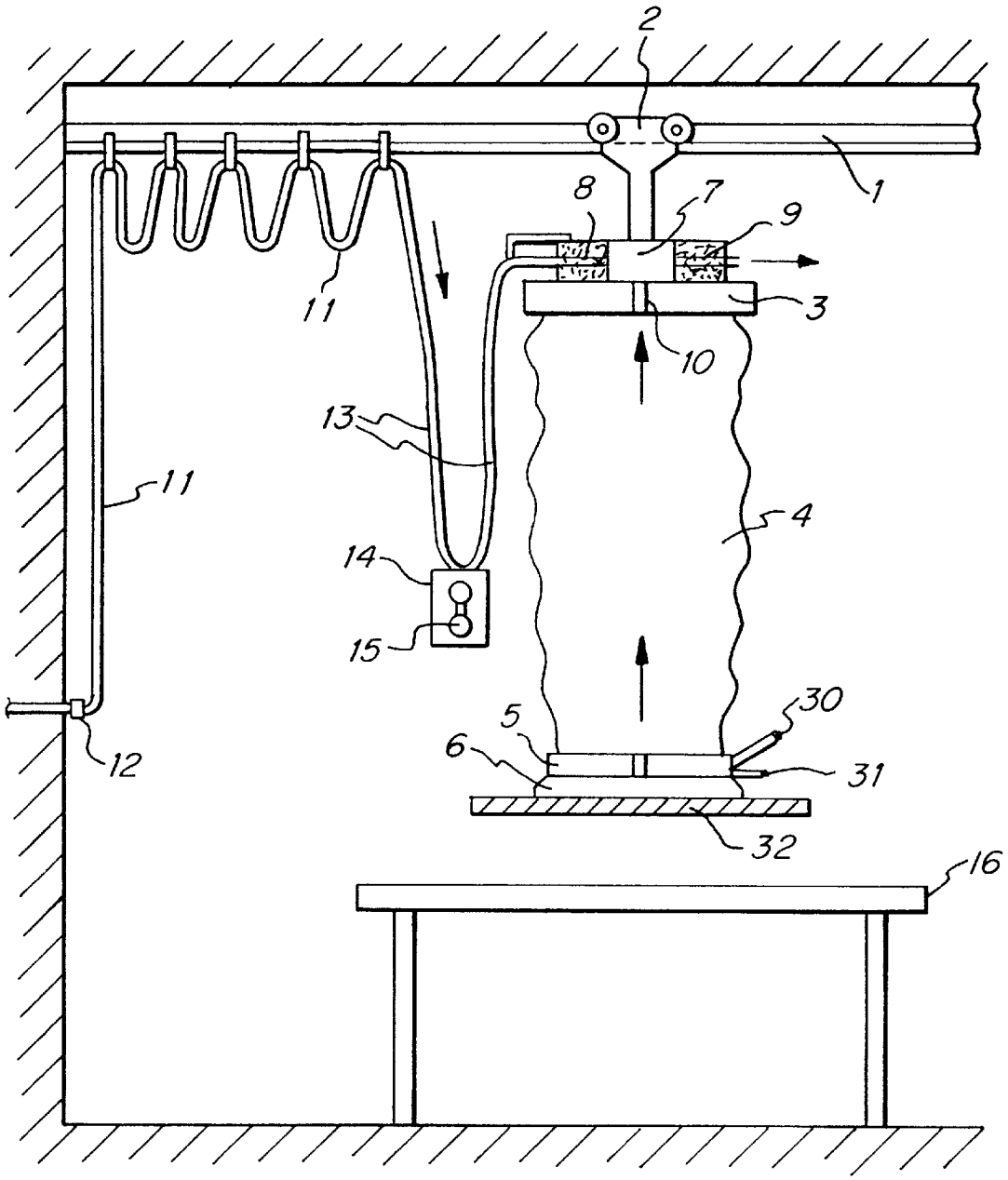
FIG. 1 is a side view of a first embodiment of the invention with portions in section to show internal structure.

FIG. 1 shows a rail 1 on which a trolley 2 is travelling. The upper part 3 of a lifting tube 4 is hanging from the trolley 3. The lower part 5 is provided with one or more suction cups 6, and a vacuum source comprising an ejector 7 driven by compressed air and provided with a silencer 8 and an air filter 9 is mounted on the upper part 3. The suction side of the ejector 7 is via a channel 10 connected to the interior of the lifting tube 4. The ejector 7 is driven from a compressed air tube 11, which via a loop 13 handing down from the ejector 7 and the compressed air tube 11 is connected to the ejector 7 and at the other end to a nipple 12 belonging to a central compressed air plant. A valve 14 for regulating the flow of compressed air is connected to the lowest part of the loop 13 and controlled by a manually operated regulating means 15. The control of the lifting tube 4, thus, is obtained by regulating the pressure of the driving air to the ejector 7 instead of driving the ejector 7 or other vacuum source all the time at maximum capacity, as previously done. In some cases when it is necessary to obtain short lifting time periods, it may be suitable to have two ejectors connectable, one big ejector for the lifting phase and one smaller ejector automatically connectable for maintaining the vacuum level as long as the load is kept at a constant lifting level.

In this way, the air and energy consumption is essentially reduced after an object 32 has been lifted from a support 16. An air supply cycle consisting of lifting, transport and lowering may extend over about 40 seconds with a lifting time period of 4 seconds. It can easily be shown that with a device according to the invention a reduction of the air consumption during an air supply cycle amounting to 43% is obtained in comparison with previously known device.

Figure 2:
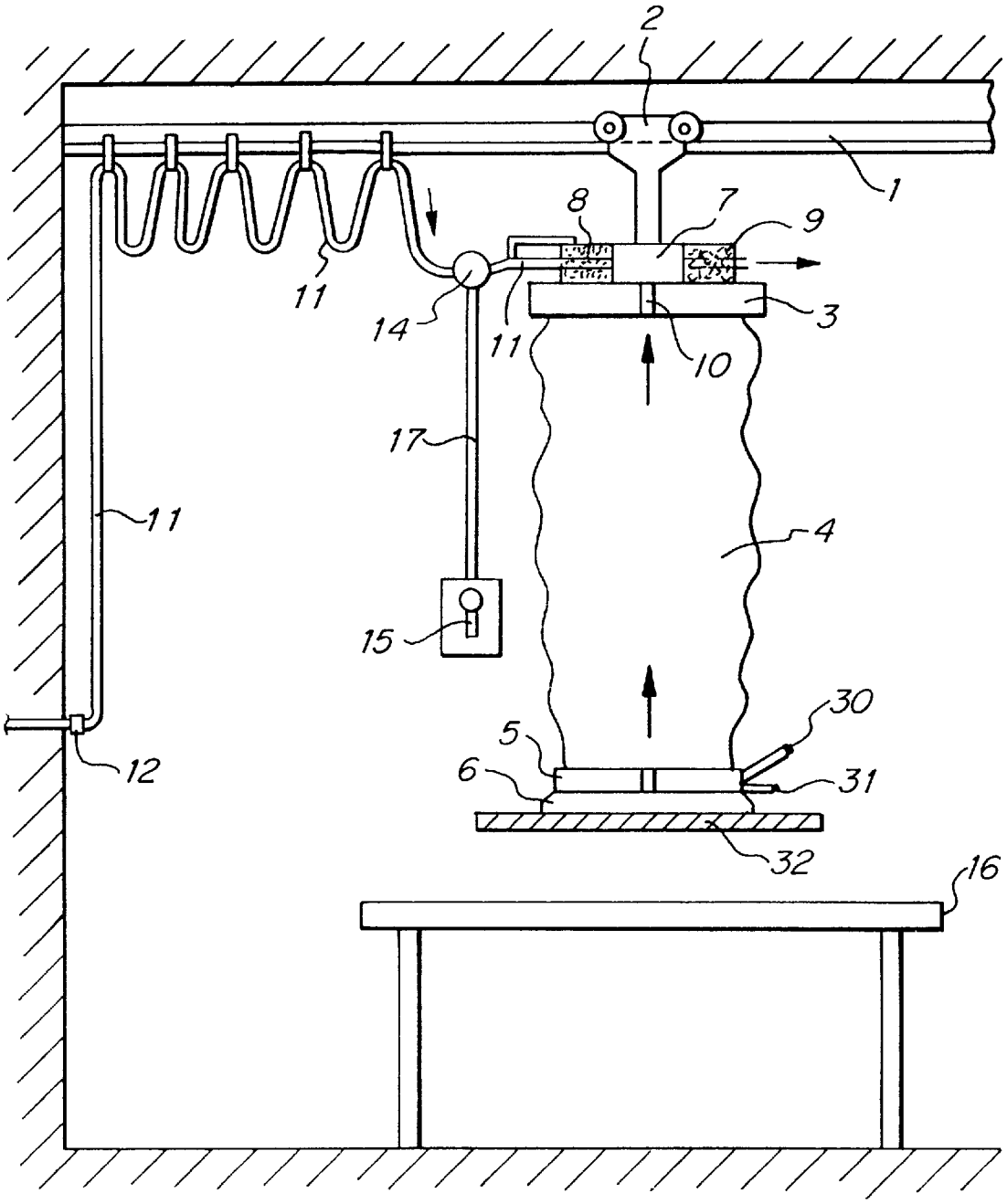
FIG. 2 is a side view of a second embodiment with portions in section to show internal structure.

The device shown in FIG. 2 differs from the device shown in FIG. 1 by the valve 14 being connected in the compressed air tube 11 at its connection to the ejector 7 and arranged to be controlled by a regulating means 16, which is connected to the valve 14 by a bowden control cable 17 or similar hanging down from the ejector 7.

Figure 3:
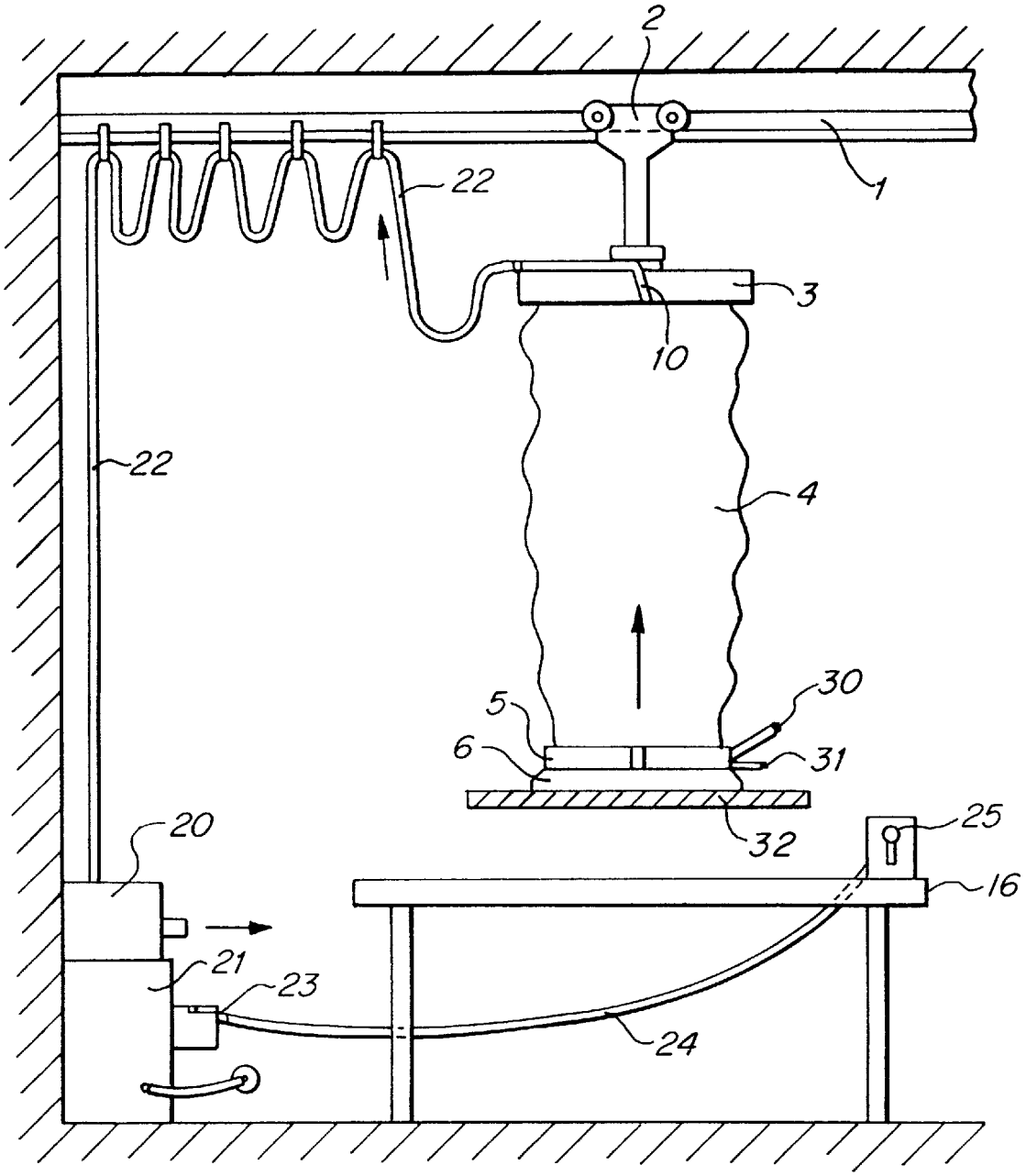
FIG. 3 is a side view of a further embodiment with portions in section to show internal structure.

As an alternative, the vacuum source may consist of a vacuum pump 20 driven by an electrical motor 21, as shown in FIG. 3. The upper part 3 with the channel 10 of the lifting tube 4 is connected to the suction side of the vacuum pump 20 via a suction tube 22. The current consumption of the motor 21 is regulated by a current valve 23 belonging to the supply circuit (not shown) of the motor 21, which valve 23 is remote controlled in a suitable way, for instance by a bowden control cable 24 with a regulating means 25 connected to the bowden control cable 23.

The invention is of course not limited to the embodiments shown and described here but can be modified in various ways within the scope of the inventive idea defined by the claims. In the embodiment according to FIG. 3, the suction tube 22 may, as an alternative, be connected to a central suction circuit with a valve 14 connected in the suction tube for controlling the suction flow in a way similar to the way described above. Further, in all embodiments, the lower part of the lifting tube may be provided with a handle 30 for maneuvering of the suction device consisting of the suction cup or cups and a manually operated valve 31 in connection to the handle for letting in air into the lifting tube in order to achieve a rapid lowering of the suction device and release of the object handled by the suction device, especially when the object 32 is an air impervious object 32. Also a vacuum pump driven by an electric motor may, of course, be mounted on top of the upper part 3 of the lifting tube 4 in a similar way as the ejector device in FIGS. 1 and 2. Further, the motor-driven vacuum pump 20 in FIG. 3 may be replaced by an ejector device. The components at the upper part 3 of the lifting tube 4 as well as the connection of the suction tube 22 may also be moved to the lower part 5 the lifting tube 4.

What is claimed is:

1. In a vacuum hoisting device for lifting in a lift cycle an object having a weight, the vacuum hoisting device comprising:

(a) a vertical lifting tube suspended at an upper part, the vertical lifting tube being axially extensible and contractible depending upon air pressure in the vertical lifting tube;

(b) a vacuum source connected to the vertical lifting tube and having a suction capacity;

(c) at least one suction cup at a lower part of the vertical lifting tube; and (d) a regulating device upstream of the vacuum source and operated by an energy input regulator to manually adjust energy input to the vacuum source during the lift cycle to control the suction capacity of the vacuum source depending on a desired air pressure in the vertical lifting tube, the desired air pressure being a function of the weight of the object being lifted.

2. A device according to claim 1, wherein the vacuum source includes an ejector device driven by compressed air, the regulating device and energy input regulator being arranged to control the suction capacity through flow of compressed air to the ejector device.

3. A device according to claim 2, wherein the ejector device and the regulating device are mounted at the upper part of the vertical lifting tube, and further including a device extending down from the regulating device for remote control of the regulating device to which the energy input regulator is attached.

4. A device according to claim 3, wherein the device extending down from the regulating device is a bowden control cable.

5. A device according to claim 2, wherein the ejector drive is attached to the upper part of the vertical lifting tube, and a compressed air tube is attached to the ejector device and extends down in a loop where the regulating device and the energy input regulator for controlling flow of compressed air are mounted.

6. A device according to claim 1, wherein the vacuum source is driven by an electric motor, the regulating device and the energy input regulator are arranged to control motor speed and thereby control the suction capacity of the vacuum source.

7. A vacuum hoisting device comprising:

(a) a vertical lifting tube suspended at an upper part, the vertical lifting tube being axially extensible and contractible depending upon air pressure in the vertical lifting tube;

(b) a vacuum source connected to the vertical lifting tube and having a suction capacity, the vacuum source includes an ejector device driven by compressed air, the ejector device attached to the upper part of the vertical lifting tube;

(c) at least one suction cup at a lower part of the vertical lifting tube;

(d) a regulating device upstream of the vacuum source and operated by an energy input regulator to manually adjust energy input to the vacuum source to control the suction capacity of the vacuum source and thus the air pressure in the vertical lifting tube, the regulating device and energy input regulator being arranged to control the suction capacity through flow of compressed air to the ejector device; and (e) a compressed air tube attached to the ejector device and extending down in a loop where the regulating device and the energy input regulator for controlling flow of compressed air are mounted.

* * * * *

UNITED STATES PATENT AND TRADEMARK OFFICE

CERTIFICATE OF CORRECTION

PATENT : 6,056,500

DATED : May 2, 2000

INVENTOR(S): VACUUM HOISTING DEVICE HAVING A VERTICALLY SUSPENDED LIFTING TUBE

It is certified that error appears in the above-identified patent and that said Letters Patent is hereby corrected as shown below:

On the Title page under FOREIGN PATENT DOCUMENTS, "of 0000" should be --8/1988--.

In column 1, line 49, "single" should be --simple--.

In column 2, line 21, "handing" should be --hanging--.

In column 2, line 44, "device" should be --devices--.

In column 3, line 8, after "object" (second occurrence), "32" should be deleted.

Signed and Sealed this

Twentieth Day of March, 2001

Nicholas P. Godici

*Attest:*

NICHOLAS P. GODICI

*Attesting Officer*

*Acting Director of the United States Patent and Trademark Office*